US006471120B1

(12) United States Patent
Vogel

(10) Patent No.: US 6,471,120 B1
(45) Date of Patent: Oct. 29, 2002

(54) EASY OPENING HANDLED CARTON

(75) Inventor: Steven A. Vogel, Lawrence, KS (US)

(73) Assignee: Colgate Palmolive Company, New York, NY (US)

( * ) Notice: Subject to any disclaimer, the term of this patent is extended or adjusted under 35 U.S.C. 154(b) by 0 days.

(21) Appl. No.: 10/028,611

(22) Filed: Oct. 25, 2001

(51) Int. Cl.[7] ..... B65D 17/28

(52) U.S. Cl. ..... 229/117.16; 229/122.27; 229/123.2

(58) Field of Search ..... 229/117.16, 122.27, 229/122.29, 122.31, 123.2, 211, 243, 244

(56) References Cited

U.S. PATENT DOCUMENTS 2,726,803 A * 12/1955 Ketler ..... 229/122.29
2,778,562 A * 1/1957 Tilly ..... 229/123.2
2,800,266 A * 7/1957 Kelly ..... 229/123.2
3,145,901 A * 8/1964 Gile ..... 229/122.27
3,246,825 A * 4/1966 Zastrow ..... 229/117.16
RE26,107 E * 11/1966 Rasmussen et al. ..... 229/224
3,302,857 A * 2/1967 Martin ..... 229/244
3,666,164 A * 5/1972 Nederveld ..... 229/122.27
5,642,833 A * 7/1997 Ring ..... 229/117.16
5,918,801 A * 7/1999 Milio ..... 229/243

* cited by examiner

*Primary Examiner*—Gary E. Elkins
(74) *Attorney, Agent, or Firm*—Michael J. McGreal

(57) ABSTRACT

The present bag-in-a-box package is of a three unit structure, having a top unit, a body unit and a bottom unit. The box has a pair of handles for ease in handling the box and a tear strip structure for opening the box. In a preferred mode the tear strip has a grip that is adjacent one of the handle apertures. The tear strip can be of any known structure such as a series of perforations or serrations, or a separate film, string or filament applied to the top panel. This makes the tear strip easier to grip and the box easier to open. The bag part of the structure will preserve the freshness of the contained product while the box will provide structural integrity and a means for easily handling the box.

16 Claims, 8 Drawing Sheets

EASY OPENING HANDLED CARTON

FIELD OF THE INVENTION

This invention relates to an easy opening handled carton. More particularly, this invention relates to a handled carton that has a tear strip to provide for an opening of the full top of the carton.

BACKGROUND OF THE INVENTION

Many products such as pet foods are sold in large bags. These bags range in size from 20 pound to 40 pound and larger bags. These bags can be difficult to handle and further may not provide sufficient protection for the pet food or similar products when they are of a less hardened consistency. In such an instance a different type of package is needed. An effective type of package is a bag in a box package. The bag is of a structure to maintain the freshness of the product while the box will provide physical integrity protection for the contained pet food product. Further, this type of package provides for more effective stacking at the warehouse or retail store. Also, the bag-in-a-box of the present design provides for easy handling and easy opening.

There also is an additional advantage of the bag-in-a-box of the present design to the user. The box will stand on end and provide a neat package for using and storing the product. The box or carton is easily maneuvered by the handles. It is easily opened through the use of the tear strip. This allows two major flaps on one end to be opened. When opened, the bag is exposed and can be opened. The bag can be opened to remove product and reclosed by the use of a twist tie, or if it has a zipper, the closing of the zipper. The box will hold the bag upright throughout use. This is in contrast to a bag which somehow must be supported during use and layed down after use. Such bags when layed down take up more shelf or floor space.

There is a further advantage of this bag-in-a-box in that the bag can be constructed of much thinner laminate film. These bags will have a multi-ply film with the different plies providing differing properties. These include moisture barrier, organic barrier for flavors and nutrients, oxygen barrier and strength and puncture resistant plies. By the box providing strength and integrity to the overall package, the bag weight can be reduced with a cost savings for the bag. For instance, strength and puncture resistant plies can be minimized.

BRIEF SUMMARY OF THE INVENTION

This invention relates to a bag in a box package that is easy to handle and easy to open. Further this package structure provides for an easy stacking of the product at the retail outlet and protection for the product. The box part of the package has at least two handles and an easy opening tear strip.

This present package is comprised of a bag which can be a monolayer or multilayer laminate comprised of metal foils and/or plastics. The structure of the bags will be dependent on the requirements of the product to be packaged, usually a pet food product. The box is of a three-piece structure. There are top and bottom pieces, and a body piece comprising the sidewalls and the associated top and bottom flaps. The top flaps will be attached to the top piece and the bottom flaps to the bottom piece. The top piece will have an easy opening device such as a tear strip. The tear strip will extend longitudinally across the top of the box and optionally down a part of the sidewall to the area of the handle openings.

The body piece is comprised of the front and rear walls and the two sidewalls. The sidewalls will each have a handle aperture in the upper portion of each sidewall. These apertures are sized to permit about four fingers to extend through the aperture. In a preferred embodiment the gripping end of the tear strip to open the top of the box will form part of the top of one of the apertures. In this way it can easily be gripped and pulled to open the top of the box. The tear strip will extend up the sidewall to the top of the box, and then across the top. When the tear strip is removed, the main top panels can be opened by breaking weakened perforated areas on two sides. The bag then is opened. Although the bag can be removed from the box, it will be retained in the box since the products in the bag are easier to store in this condition.

The box can be constructed of paperboard or corrugate. It is preferred that the box be a corrugate box. Such boxes provide high strength at a low weight.

DETAILED DESCRIPTION OF THE INVENTION

The invention now will be described with reference to the drawings. The drawings set out a preferred embodiment of the invention with variations possible and be within the concept of the invention.

Figure 1:
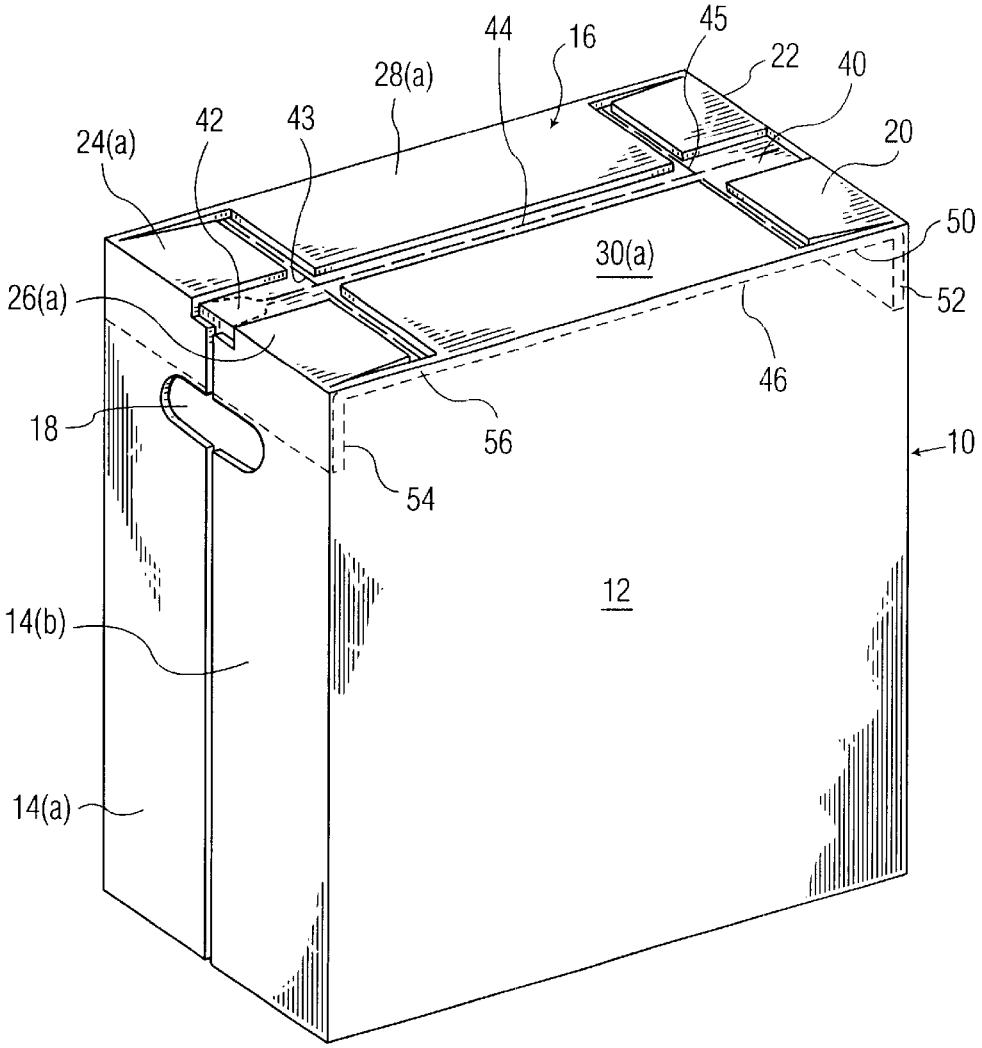
FIG. 1 is a perspective view of the carton fully constructed and standing on its base.

FIG. 1 is a perspective view of the box in a fully assembled and filled condition. This is the condition in which the box will be found in a retail store. The box 10 is comprised of a body unit, top unit and a bottom unit. The body unit has a front wall 12 and sidewall 14 comprised of sidewall panels segments 14(*a*) and 14(*b*). Side aperture 18 is in an upper part of this sidewall 14. This sidewall 14 has two segment panels 14(*a*) and 14(*b*) since this is a split end panel of the box blank. The top wall 16 is comprised of top panel unit 40 with tear strip 44 and tear strip grip 42, major body flaps 28 and 30 and minor body flaps 20, 22, 24(*a*) and 26(*a*). The flaps 30(*a*) and 30(*b*) extend from the front wall 12, flaps 20, 21 and 22 from sidewall 15 (see FIG. 3), flaps 24(*a*) and 24(*b*) from sidewall panel 14(*a*), flaps 26(*a*) and 26(*b*) from sidewall 14(*b*), and flaps 28(*a*) and 28(*b*) from rear panel 13. The top panel unit 40 which has tear strip 44 is attached by an adhesive or an equivalent to the flaps 30(*a*), 28(*a*), 24(*a*), 26(*a*), 22 and 20 and to each sidewall at a top part. The structure of top panel unit 40 in the box is shown in dotted lines in FIG. 1. Shown in this top panel are weakened areas 43 and 45 to facilitate the opening of the end of the box after the tear strip has been removed. These can be perforated or serrated weakened areas.

Figure 2:
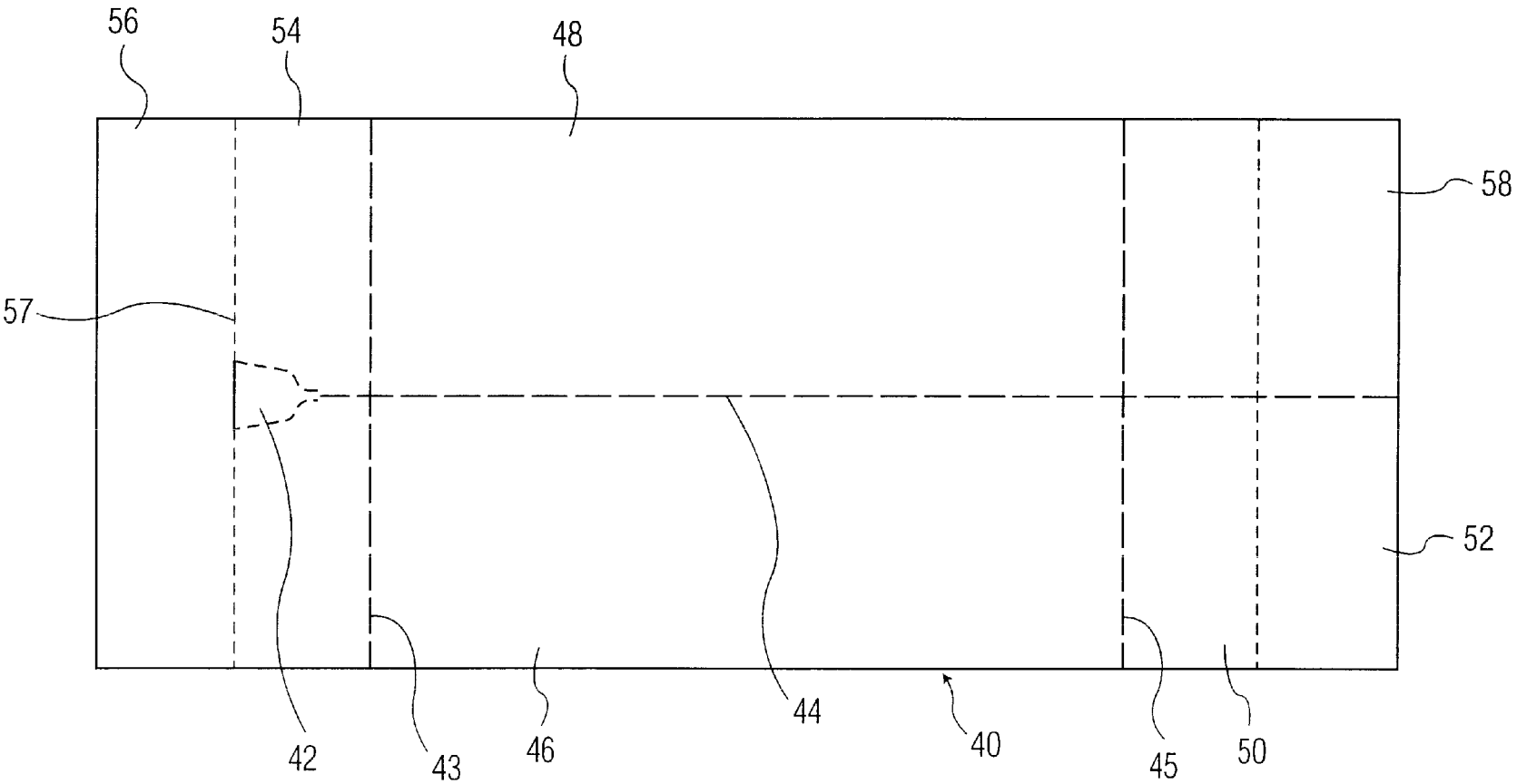
FIG. 2 is a view of the blank that comprises the top of the carton.

FIG. 2 shows the blank for the top panel unit 40. There is shown integral tear strip 44 and tear strip grip 42. There are shown longitudinal panels 46 and 48 on each side of the tear strip. There are panels 54 and 56 at one end of the top piece and panels 50 and 52 on the other end of the top piece. The weakened areas 43 and 45 can be broken when the tear strip is removed so that flaps 46 and 48 can be opened when the box is fully assembled. Fold lines 57 and 58 delineate the downwardly extending panels for adhesive attachment to sidewall panels 14(*a*), 14(*b*) and 15. The tear strip 44 can be separate from top panel unit 40. If a separate strip 16 applied to the top unit to assist tearing, it is applied on the inner surface (inside of box) of the top unit blank (40). Any tear strip structure that is known in the art can be used. This can be perforations, serrations or a film, string or filament applied to the top panel unit.

The bottom panel unit usually will be the same as the top panel unit except that it will not have a tear strip and tear strip grip. It will be attached to the lower part of the body of the box in the same manner as the top panel unit is attached to the upper part of the body of the box.

Figure 3:
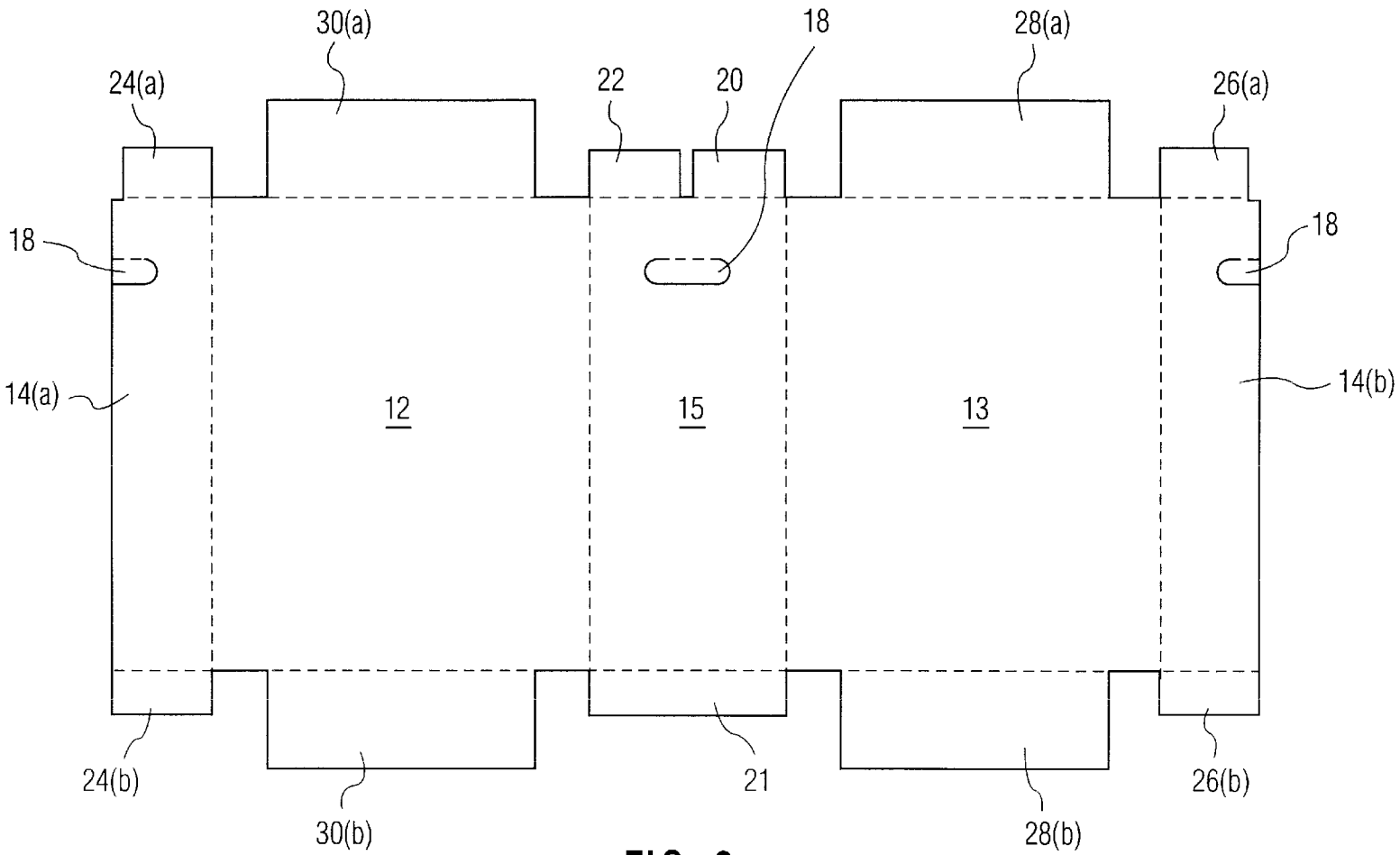
FIG. 3 is a view of the blank that comprises the body side panels of the carton.

FIG. 3 shows the body blank which is comprised of front panel 12, rear panel 13 and sidewall panels 15, 14(*a*) and 14(*b*). Sidewall panels 14(*a*) and 14(*b*) form the full sidewall 14. Apertures 18 are shown at an upper part of each sidewall panel. Associated with the front panel 12 are top flap 30(*a*) and bottom flap 30(*b*) and with rear panel 13 top flap 28(*a*) and bottom flap 28(*b*). The sidewall panel 15 has top flaps 20 and 22 and bottom flap 21. Associated with sidewall 14(*a*) are top flap 24(*a*) and bottom flap 24(*b*), while associated with sidewall 14(*b*) are top flap 26(*a*) and bottom flap 26(*b*). The top flaps are glue or adhesive flaps that attach the top of the body of the box to the top panel unit while the bottom flaps are glue or adhesive flaps that attach the bottom of the body of the box to the bottom panel unit. This box body is folded at the edges of the panels and flaps to form the box body. The dashed lines are the fold lines.

Figure 4:
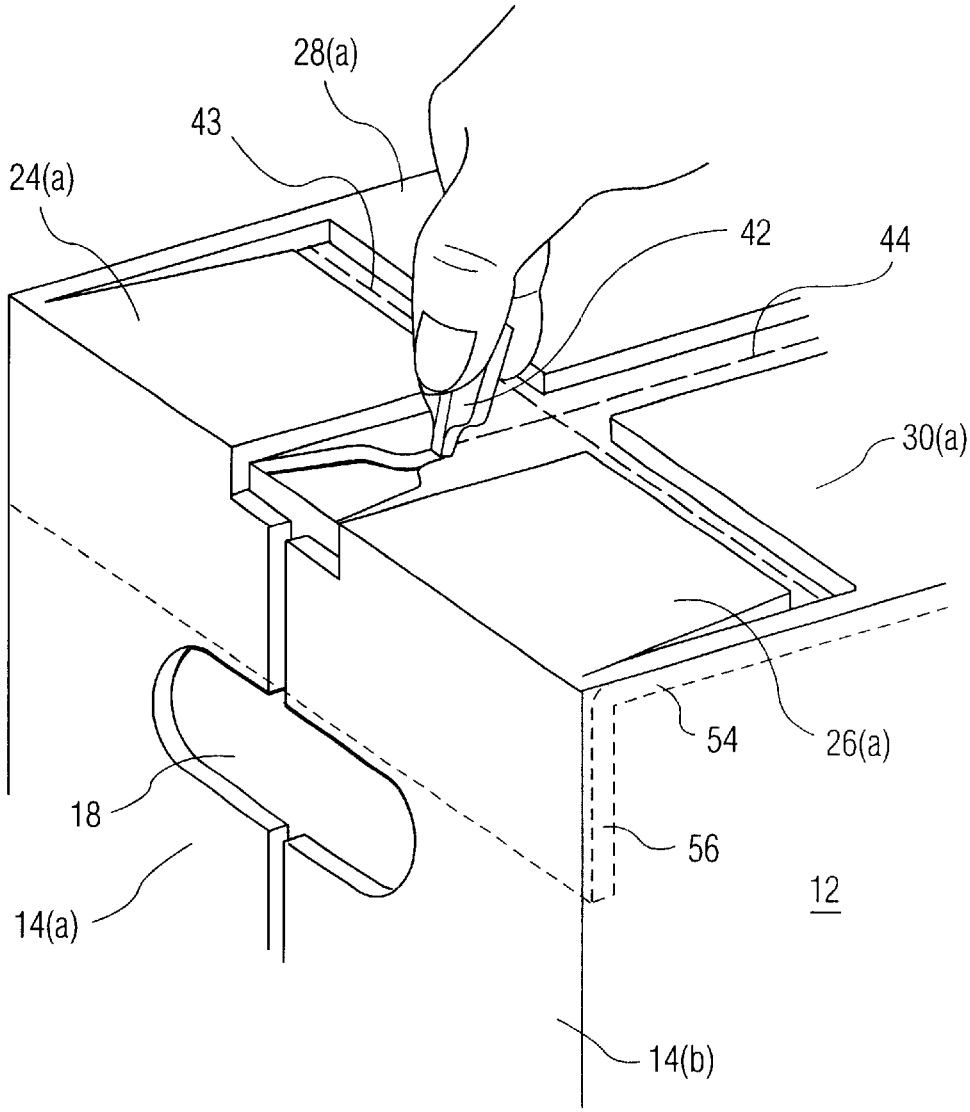
FIG. 4 is a partial view of the carton of FIG. 1 with the top tear strip being removed.
Figure 5:
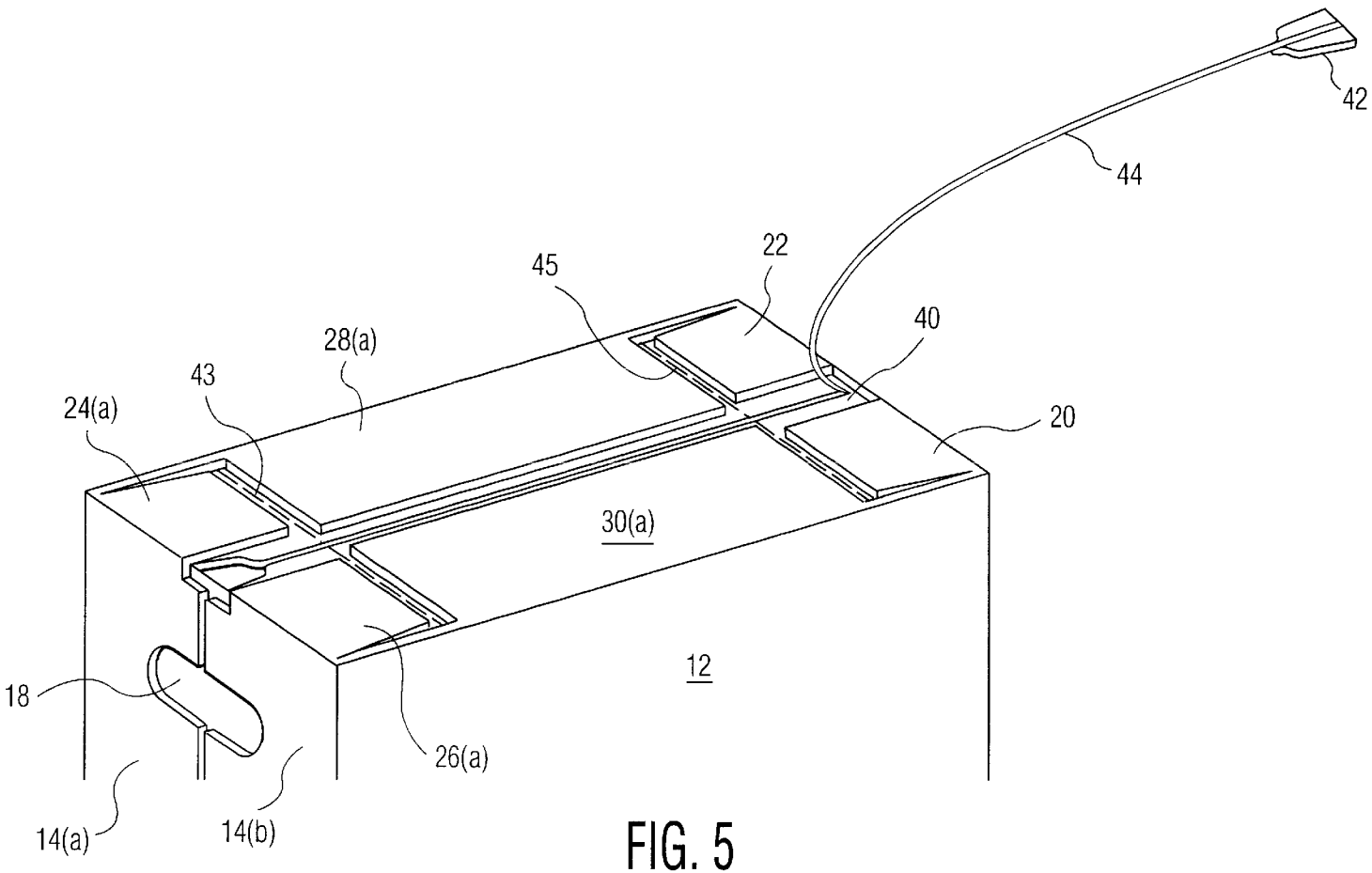
FIG. 5 is a partial view of the carton of FIG. 1 showing the tear strip mostly removed.

FIG. 4 shows the box of FIG. 1 in a partial view being opened. Grip 42 of the tear strip is being pulled to remove it from the carton. This tear strip is pulled longitudinal across the top of the box as shown in FIG. 5. Upon the full removal of the tear strip 44 the top of the box can be opened by breaking weakened areas 43 and 45. Upon these weakened areas being broken, flaps 26(*a*) and 28(*a*) will open upward. The bag 90 then can be opened and product dispensed.

Figure 7:
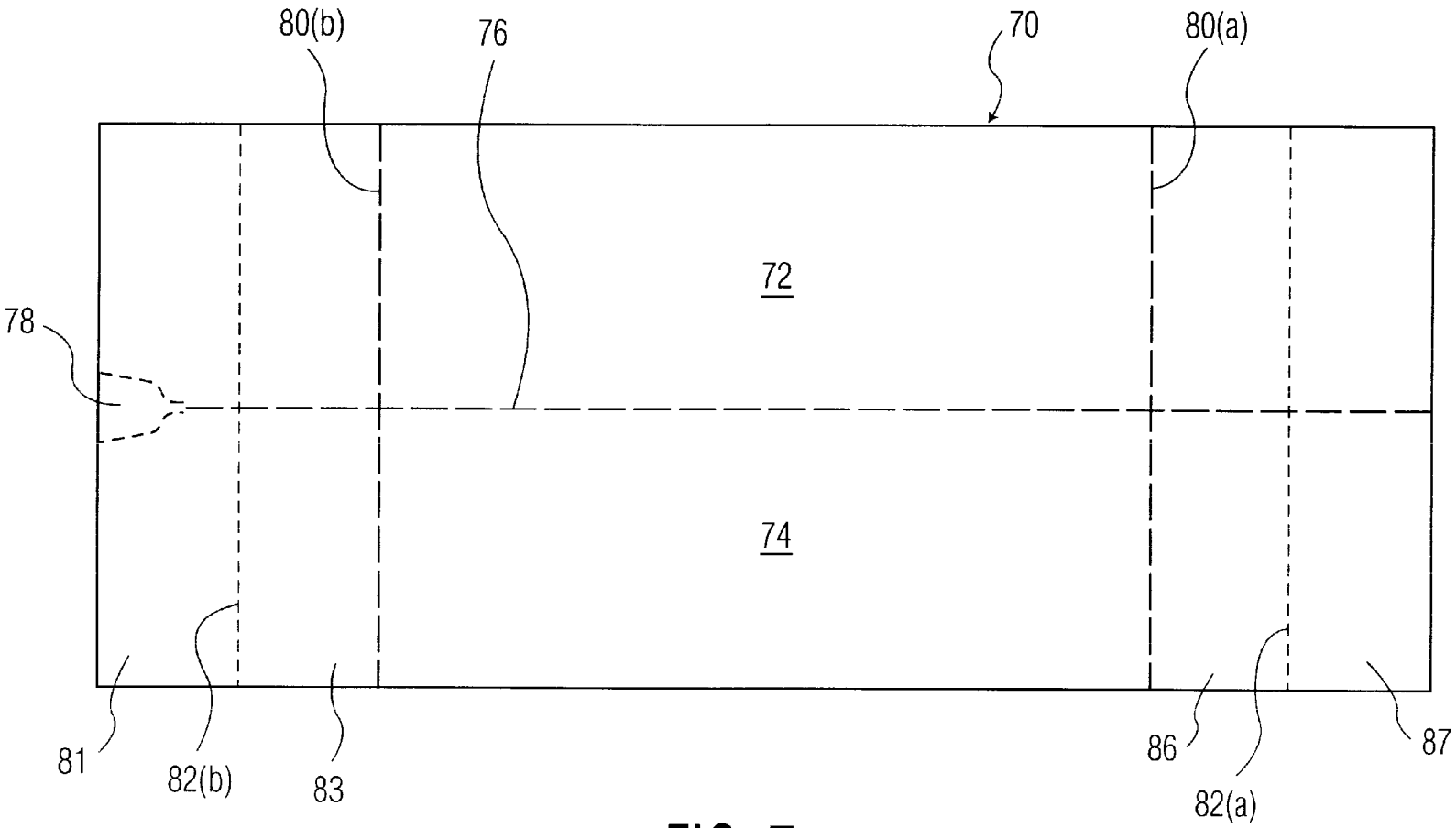
FIG. 7 is a view of an alternate blank that comprises the top of the carton.

FIG. 7 shows an alternate structure for the top panel unit 70. This top panel unit differs from that of FIG. 2 (panel unit 40) in that the tear strip grip 78 will be at the edge of the panel 81 rather than at the edge of panel 81 adjacent to panel 83. In this way the grip 78 will be located at the edge of handle opening 18 of the box. Otherwise the top panel units of FIG. 2 and FIG. 7 are the same. These are longitudinal panels 72 and 74, weakened areas 80(*a*) and 80(*b*) and fold lines 82(*a*) and 82(*b*). These fold lines allow panels 86 and 87 and panels 81 and 83 respectively to fold. Panels 81 and 87 become adhesive glue panels to secure the top panel unit to the box body.

Figure 6:
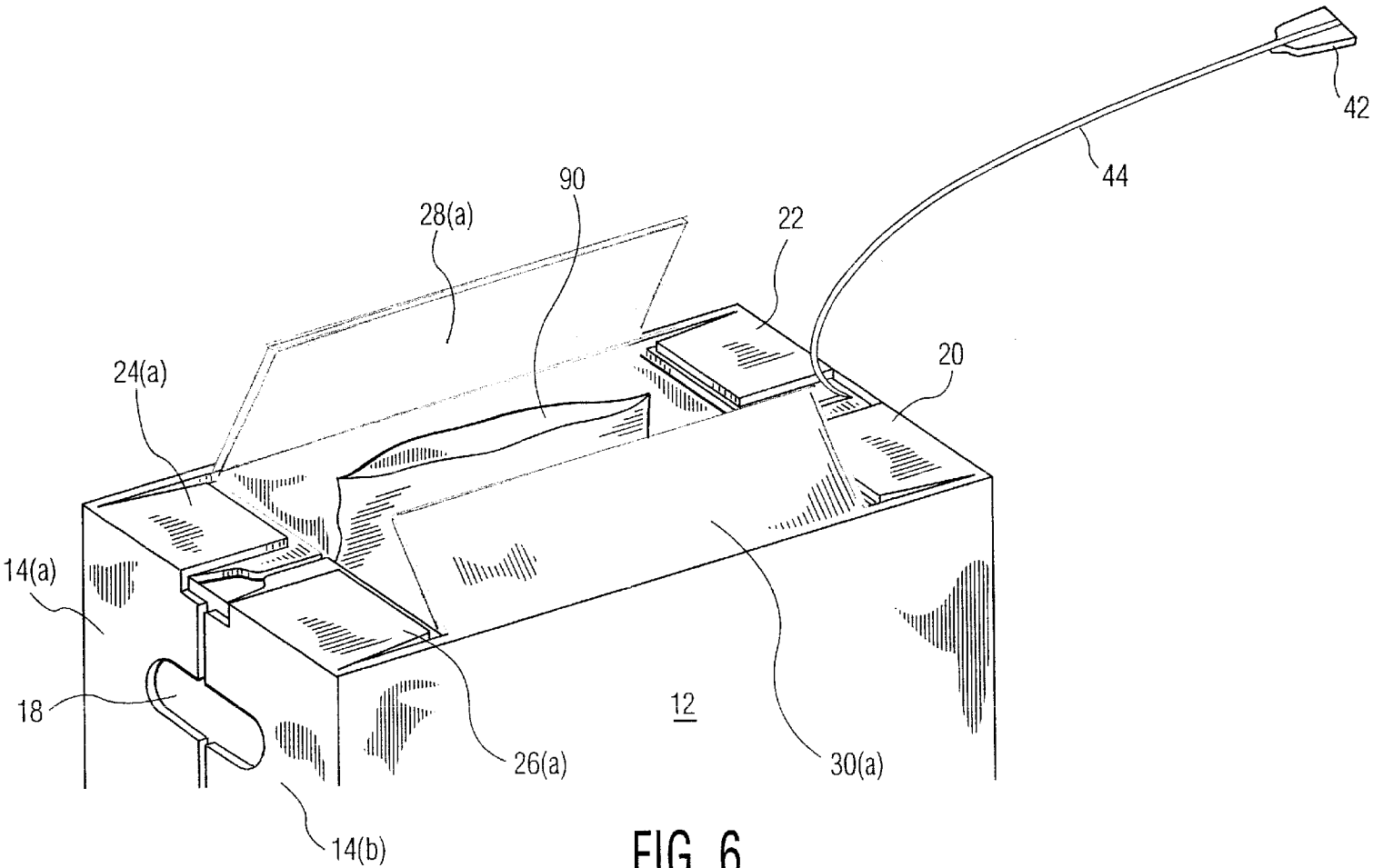
FIG. 6 is a partial view of the carton of FIG. 1 mostly opened.
Figure 8:
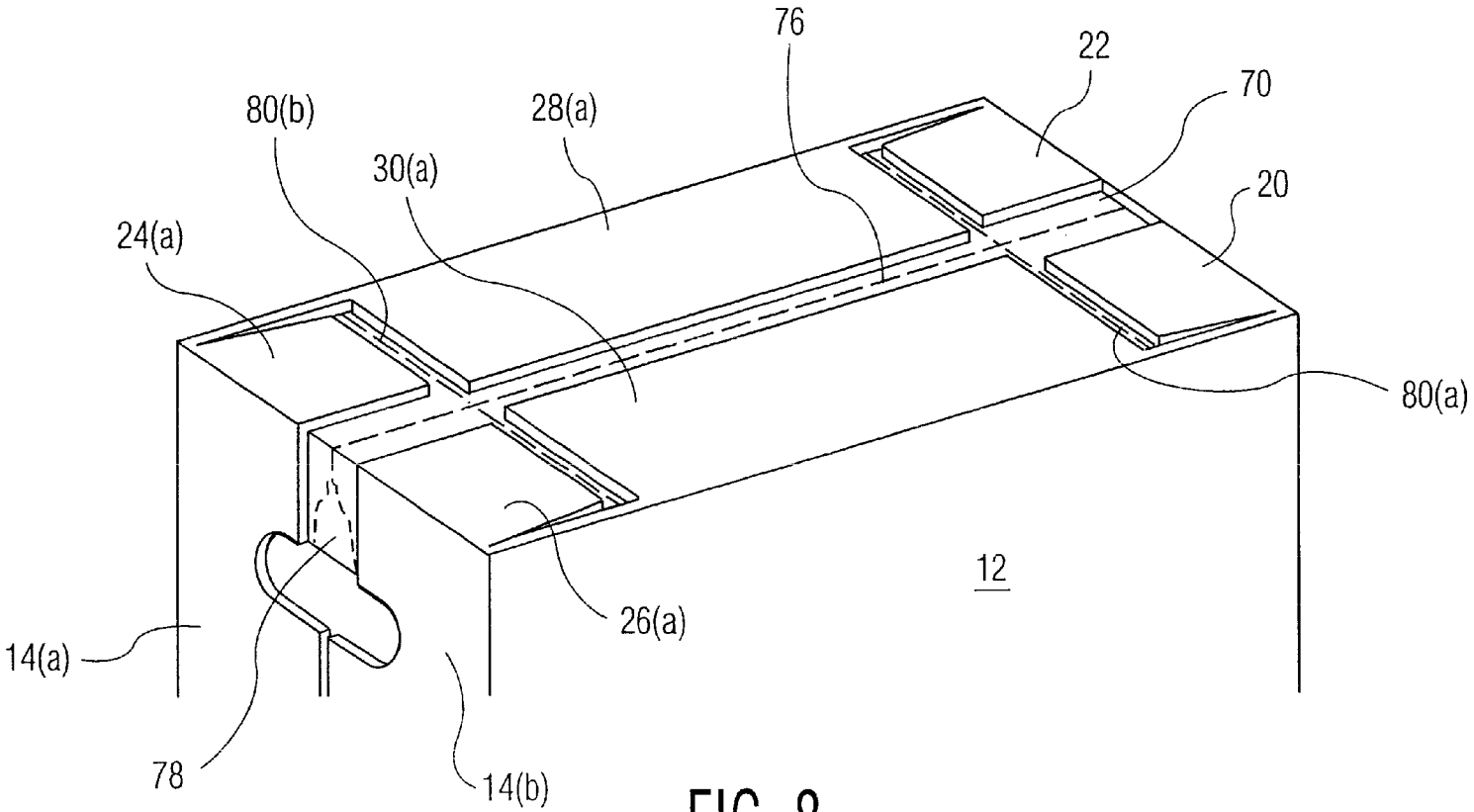
FIG. 8 is a partial view of the carton with the alternate top blank of FIG. 7.

FIG. 8 shows the box of FIG. 1 with the top panel unit 70 of FIG. 7. There also is provided in this embodiment an increased spacing between flaps 24(*a*) and 26(*a*) and the part of sidewall panels 14(*a*) and 14(*b*) above handle aperture 18. This is to facilitate the gripping of tear strip grip 78 for the removal of tear strip 76. The top of this box then is opened in the same manner as shown for the box in FIGS. 4 through 6.

The box can be constructed of a paperboard or of corrugate. The use of corrugate is preferred for its strength characteristics.

In use the box is formed by wrapping the body piece around the two end pieces. The filled bag then is inserted through panel 14(*a*) and 14(*b*) which are then glued closed. The attachment of the bottom piece and top piece to the box body is through the body flaps that are glued to the bottom and top units and the end panels of the top and bottom units adhesively attached to the sidewalls of the box body.

At the point of purchase of the product the handles 18 are useful in handling and carrying the box. The box provides a high degree of integrity to the product during shipping, storage and retail sale.

The box can easily be carried to a store checkout counter and then to a vehicle for transport home. In the vehicle the box can be maintained upright or on its side depending on the space available. In a home the box can be stored upright in a corner or closet. During use it will be maintained in this same orientation. The box is opened by gripping the end of the tear strip (44, 76) on the top panel unit (40, 70) and pulling it across the top to sever this top panel. The top box flaps then are pulled open and the contained bag opened. This bag can be closed by a twist tie or by a zipper closure. The desired amount of contents are removed and the bag reclosed. The box flaps also can be closed over. This box with its contents will remain neatly stored until all of its contents are removed.

What is claimed is:

1. A carton comprised of three units, a body unit, a top unit and a bottom unit, the body unit comprising a front panel and a rear panel, said front panel and rear panel connected by at least two side panels, each of said front panel, rear panel and at least two side panels having at least one flap attached to a bottom and a top horizontal edge thereof, the bottom unit and the top unit having at bottom unit panel and top unit panel respectively along at least one edge thereof, the bottom unit and the top unit attached to an inner surface of a wall of said body unit through the attachment of said at least one bottom unit panel and said at least one top unit panel to said inner surface of said wall of said body unit, said top unit having a tear strip extending from about adjacent one panel of said at least two side panels across at least a portion of said top unit.

2. A carton as in claim 1 wherein said carton has a handle aperture in at least one side panel adjacent the top unit.

3. A carton as in claim 2 wherein a handle aperture is in each side panel adjacent the top unit.

4. A carton as in claim 1 wherein the tear strip has a grip structure on one end thereof.

5. A carton as in claim 4 wherein said tear strip extends the full extent of the top unit.

6. A carton as in claim 2 wherein said tear strip extends down along said side panel to adjacent said handle aperture.

7. A carton as in claim 6 wherein the tear strip has a grip structure on one end thereof adjacent said handle aperture.

8. A carton as in claim 1 wherein each of said top unit and said bottom unit have at least two panels to attach said top unit and said bottom unit to an interior surface of said side panels of said body unit.

9. A carton as in claim 1 wherein said top unit and said bottom unit are additionally attached to said body unit by said at least one flap attached to one of said bottom horizontal edge and said top horizontal edge of said front panel and said rear panel.

10. A carton comprised of three units, a body unit, a top unit, and a bottom unit, the body unit comprising a front panel and a rear panel, the front panel and rear panel connected by side panels, each of said front panel, rear panel and side panels having at least one flap on a bottom and on a top horizontal edge thereof, the bottom unit at least attached in part to the body unit by at least one of the flaps on the bottom edge of the front panel, rear panel and side panels, said top unit at least attached in part to the body unit by at least one of the flaps on the top edges of the front panel the rear panel and the side panels, at least one of said side panels having a handle aperture adjacent said top unit, a tear strip in said top unit, at least one end of said tear strip adjacent said handle aperture in said side panel to provide an easy gripping of said at least one end of said tear strip to facilitate the removal of said tear strip.

11. A carton as in claim 10 wherein each side panel has a handle aperture.

12. A carton as in claim 10 wherein said tear strip extends from about adjacent one of said side panels to about adjacent another of said side panels.

13. A carton as in claim 12 wherein said tear strip extends across the full extent of said top unit.

14. A carton as in claim 12 wherein said tear strip has a grip structure on at least one end.

15. A carton as in claim 13 wherein said tear strip extends down along at least one side panel to adjacent the handle aperture.

16. A carton as in claim 15 wherein said tear strip has a grip structure adjacent the handle aperture.

* * * * *